United States Patent [19]

Cooper

[11] Patent Number: 4,915,731

[45] Date of Patent: Apr. 10, 1990

[54] METALLURGICAL METHOD AND APPARATUS

[76] Inventor: Belton Y. Cooper, The Herman Williams Company, Inc., 3517 Tenth Ave., N., Birmingham, Ala. 35234

[21] Appl. No.: 280,445

[22] Filed: Dec. 6, 1988

[51] Int. Cl.[4] ..... C21B 13/12

[52] U.S. Cl. ..... 75/26; 75/10.22; 75/40; 266/80; 266/156; 266/182

[58] Field of Search ..... 75/26, 40, 10.19, 10.2, 75/10.22; 266/182, 80, 78, 79, 156

[56] References Cited

U.S. PATENT DOCUMENTS

| | | | |
|---|---|---|---|
| 2,184,300 | 12/1939 | Hodson et al. | 266/172 |
| 2,688,478 | 9/1954 | Lykken | 75/40 |
| 2,782,022 | 2/1957 | Strohmeier | 266/156 |
| 3,607,224 | 9/1971 | Blaskowski | 75/26 |
| 3,720,404 | 3/1973 | Carlson et al. | 266/80 |
| 3,862,834 | 1/1975 | Von Waclawiczek et al. | 75/10.22 |

*Primary Examiner*—Melvyn J. Andrews

*Attorney, Agent, or Firm*—Roylance, Abrams, Berdo & Goodman

[57] ABSTRACT

Method and apparatus for recovering a metal from an ore by kinetic metallurgy as distinct from the usual static blast furnace approach.

12 Claims, 2 Drawing Sheets

Figure 1:
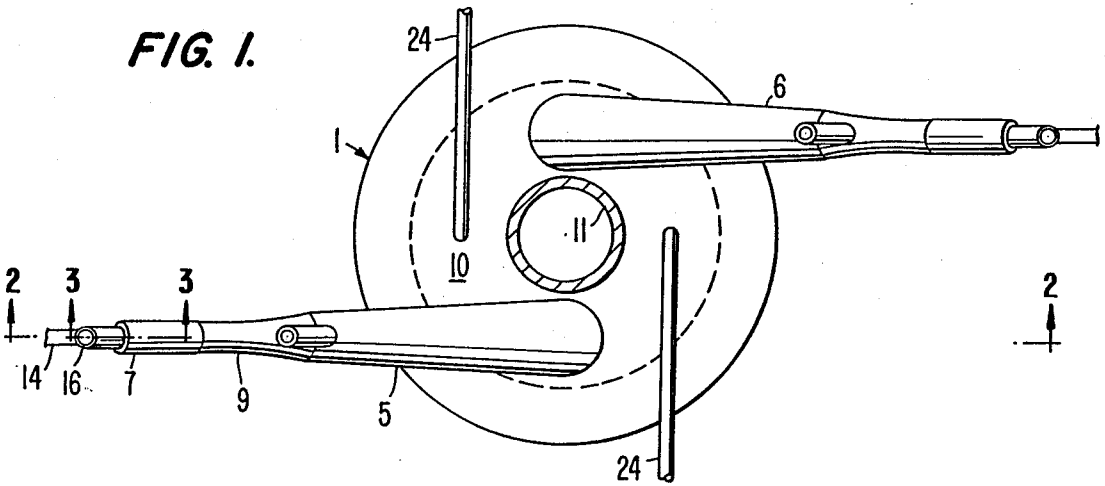

17
17a

HEAT EXCHANGER
AIR
COMPUTER
25
1
2
3
4
5
6
7
8
9
10
11
12
13
14
15
16
17
18
19
20
21
22
23
24

METALLURGICAL METHOD AND APPARATUS

This invention relates to metallurgical methods and apparatus and particularly to methods and apparatus for recovery of metals from ores containing the metal, typically the recovery of ferrous metals from ores such as magnetite.

BACKGROUND OF THE INVENTION

Though development of blast furnace systems for recovering iron from ferrous ores started at least as early as the 16th century, such systems remain as substantially the only commercial approach to recovery of metals from ores. Such systems are essentially static metallurgical systems, even when the so-called jet smelting approach described, e.g., at pages 62–64 of *The Iron Age,* Oct. 3, 1963, is employed. Thus, even when the furnace is supplied with injected streams of (1) natural gas plus oxygen or (2) additional natural gas, the ore and flux simply fall as a central stream into the furnace and both thermal efficiency and contact of the ore with the reducing gas are relatively low. Further, control of such static systems is at best difficult, and fine and continuous control virtually impossible. Accordingly, there has long been a need for better methods and apparatus for recovering metals from ores.

SUMMARY OF THE INVENTION

Considered broadly, the invention provides both a method and an apparatus for recovering metals from ores in a manner which can be characterized as kinetic metallurgy. The invention employs a refractory hearth constructed and arranged to retain a molten body of the recovered metal; the hearth including a refractory cover, an outlet for recovered metal, an outlet for slag, and an upstanding stack for exhaust of gases. Pulverized ore and flux are supplied into a hot turbulent fluid flow and the turbulent flow is then directed into the hearth along a line oriented so that the flow impinges on the surface of the molten metal in the hearth. Advantageously, the turbulent flow comprises a combustion-supporting gas and fuel and the turbulent flow is maintained as 3500°–6000° F., advantageously 4000°–5000° F., to assure combustion of the fuel as the turbulent flow proceeds toward the body of molten metal and, with the turbulent flow at such temperatures, reduction of the ore commences well before the turbulent flow enters the hearth.

Apparatus embodiments comprise at least one refractory conduit (advantageously two) which opens into the hearth and includes an inlet end and a venturi type restriction spaced from the inlet end. At the inlet end, a first means is provided for driving a hot combination-supporting gas into the conduit in such fashion that, even upstream of the venturi, the gas swirls within the conduit. A second means is provided at the inlet end for feeding the fuel into the conduit so that the fuel is entrained in the swirling hot fluid. In a location between the venturi and the hearth, a particulate mixture of ore and flux is injected into the conduit along with additional hot combustion-supporting gas so that the ore and flux are picked up and carried by the turbulent flow. The arrangement is such that the swirling motion of the turbulent flow and the action of the venturi provide a first or primary vortex and the high velocity turbulent flow from the conduit forms a secondary vortex within the hearth above the molten metal. Apart from the conduit or conduits, individual lances can be provided for injection of gases or particulate material directly into the molten metal in the hearth. The hot gas supply rates, the fuel feed rate and the rate at which ore and flux are fed are all controllable. Means are provided for analyzing the gas in both the primary vortex and the secondary vortex, and both the recovered metal and the slag are analyzed. Results of these analyses are supplied to a computer which controls the feed rates in accordance with the analyses.

Figure 4:
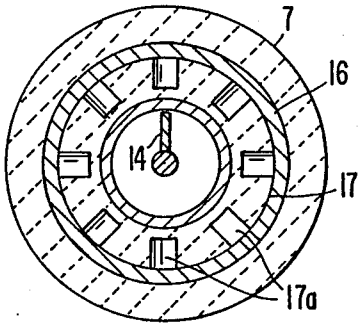
Figure 3:
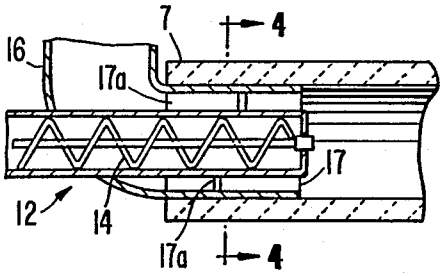
Figures 2, 5:
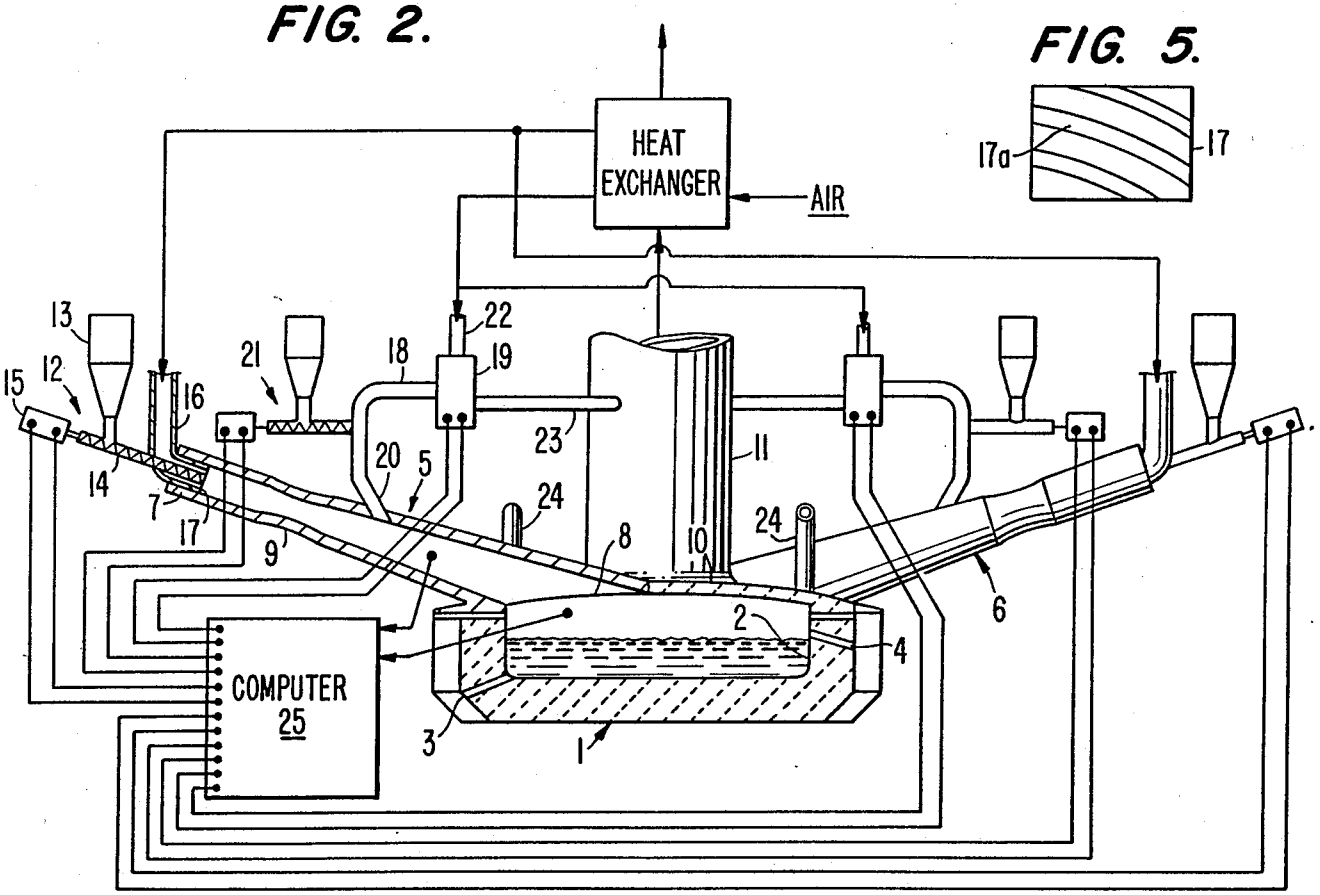

The invention will be described in detail with reference to the accompanying drawings, wherein FIG. 1 is a plan elevational view of one apparatus embodiment;

FIG. 2 is a transverse cross-sectional view taken generally on line 2—2, FIG. 1;

FIGS. 3 and 4 are cross-sectional views taken generally on line 3—3, FIG. 1, and line 4—4, FIG. 3, respectively; and FIG. 5 is a side elevational view of a flow directing insert employed in the apparatus of FIGS. 1 and 2.

One apparatus embodiment according to the invention comprises a refractory hearth 1 the interior wall of which presents a right circularcylindrical surface 2. An outlet 3 is provided to discharge molten metal from the hearth and a second outlet 4 is provided for withdrawing slag. Two identical supply conduits 5 and 6 are provided, each having an inlet end 7, an outlet end 8 and a venturi section 9, the venturi section being in an intermediate location which is nearer inlet end 7 than outlet 8. The top of the hearth is closed by a refractory cover 10 generally in the shape of an inverted shallow dish. A stack 11 is connected to the center of the cover and extends upwardly to convey gases away from the hearth. Conduits 5 and 6 extend in generally straight line fashion downwardly at a small angle, typically 22.5° but adjustable depending upon the metallurgical mix, with the outlet end 8 opening through cover 10 between stack 11 and surface 2 so that the conduit discharges along a line which is generally tangential with respect to the hearth. Outlet ends 8 of the two supply conduits are spaced apart generally diametrically across the hearth.

The inlet end of each supply conduit is equipped with a feeder, indicated generally at 12, for supplying fuel into the inlet end of the conduit. The fuel can be a pulverized solid, such as coal or coke breeze; a gas, such as natural gas or flue gas, or a liquid, such as a combustible oil. When a pulverized solid fuel such as coke breeze is to be used, feeder 12 can include a supply hopper 13 and a feed screw 14 rotated by a controllable electric motor drive unit 15, the rate of fuel supply thus being controllable by controlling the drive unit. Also at the inlet end of each supply conduit, a supply conduit 16 has its discharge end arranged to supply hot air or other combustion-supporting gas into the supply conduit concentrically around the feed screw. As best seen in FIGS. 3–5, the hot gas from conduit 16 is directed by the generally helical grooves 17*a* in a sleeve 17 so that the hot gas discharged into the inlet end of the supply conduit flows in a spiral or swirling fashion to entrain the fuel preliminarily before the turbulence caused by the venturi section is reached. A second supply pipe 18 leads from the outlet of a conventional electrically controllable gas mixing valve 19 and has its discharge end portion 20 connected to the supply conduit to discharge gasses into the supply conduit in a location adjacent to venturi section 9 on the downstream side thereof. Pulverized ore and flux are fed at a controlled rate into supply pipe 18 by a feeder 21 which is again of the type having a feed screw driven by a controllable electric motor drive unit so that the speed of rotation of the feed screw can be selected. Valve 19 has one inlet connected to a pipe 22 which supplies hot air or other combustion-supporting gas at a rate determined by adjustment of valve 19. A second inlet of valve 19 is connected to pipe 23 which receives hot gases from stack 11.

In other embodiments, a plasma arc generator can be provided at the inlet end of each supply conduit to discharge into the conduit and supplement the heat of the hot gas and burning fuel.

Two additional supply pipes 24 slant downwardly to open through cover 10 of the hearth at points respectively approximately 90° from the discharge ends of conduits 5 and 6 so that additional fuel, such as natural gas, can be injected tangentially into the hearth at these points. In the direct reduction of ore to steel, oxygen can be injected via pipes 24.

For control, a conventional computer 25 takes its inputs from conventional gas analyzers (not shown) located in supply conduits 5 and 6 and the space above the molten metal in the hearth, and from additional analyzers (not shown) for the recovered metal and the slag. The outputs of the computer are connected to control feeders 12 and 21 and mixing valve 19.

Using the apparatus of FIGS. 1–5 to practice a typical method embodiment of the invention, hot air and fuel are supplied to the inlet ends of conduits 5 and 6 at rates adequate to provide a high velocity turbulent flow in the conduits, the initial turbulence being increased by venturi sections 9 so that each supply conduit carries a primary vortex flow between the venturi section and the discharge end of the conduit, with the fuel, whether a particulate solid, such as coke breeze, or a liquid distributed in the turbulent flow. The temperature of the hot air is maintained sufficiently high to assure that combustion takes place throughout the length of the supply conduit.

Mixing valve 19 is controlled to supply both hot air and stack gases from the hearth to the supply conduits downstream of the venturi sections at controlled rates dictated by computer 25. A mixture of pulverized magnetite ore and flux is fed into supply pipe 18, again at a rate dictated by the computer, and the ore and flux are injected into the turbulent flow in the supply conduit downstream of the venturi. Since the gas flow in which the ore and flux are initially entrained contains a substantial proportion of reducing gas from the stack, and since the temperature within the supply conduit is maintained high by the combustion carried out there, the particles of ore are immediately reduced and melted in the primary vortex, i.e., within the supply conduit, and the droplets of molten iron are forcibly ejected from the supply conduit onto the body of molten metal in the hearth. The particles of lime or other flux are also forcibly ejected from the supply conduit onto the body of molten metal to provide slag formation on the surface of the molten metal.

What is claimed is:

1. The method for recovering a metal from an ore, comprising the steps of providing a hearth constructed and arranged to confine a body of molten metal having a surface;

establishing a confined high velocity turbulent flow of fuel and a hot combustion-supporting gas at a combustion temperature within at least one supply conduit having a venturi section and combusting the fuel within the supply conduit;

supplying the ore and a flux in particulate form to the confined turbulent flow within the supply conduit downstream of the venturi section to entrain the particles of ore and flux in the confined turbulent flow;

reducing and melting the ore to a molten metal within the supply conduit prior to entering the hearth;

directing the confined turbulent flow, with the reduced and melted ore entrained therein, into the hearth along a line which slants downwardly to forcibly eject the confined turbulent flow from the supply conduit onto the surface of the body of molten metal being recovered; and removing molten metal from the hearth.

2. The method defined in claim 1, wherein the line along which said confined turbulent flow is directed into the hearth extends generally tangentially with respect to the body of molten metal being recovered.

3. The method according to claim 1, wherein the particles of ore and flux are entrained in a confined flow of hot gases recovered from the hearth and the confined flow of such gases, with the ore and flux extrained therein, is injected into said confined turbulent flow of fuel and a hot combustion-supporting gas.

4. The method according to claim 3, wherein said confined flow of hot gases recovered from the hearth also contains a hot combustion-supporting gas.

5. The method according to claim 1, wherein the combustion-supporting gas is air.

6. The method according to claim 1, and further comprising controlling the supply rate of the ore and flux.

7. In an apparatus for recovery of a metal from an ore, the combination of a hearth constructed and arranged to retain a pool of molten metal having a molten metal outlet, a slag outlet, and a gas outlet;

at least one elongated conduit having an inlet end, a delivery end communicating with the hearth and which will be above a pool of molten metal being recovered, and a venturi section located between said inlet and delivery ends, said delivery end being arranged to discharge material at an angle downwardly onto the body of molten metal being recovered;

first means for supplying hot combustion-supporting gas to said inlet end at a rate such as to establish a confined turbulent flow of gas through said conduit;

second means for supplying fuel to said inlet end to be burned in said confined turbulent flow of combustion-supporting gas; and third means for supplying ore and flux in particulate form to said confined turbulent flow in a location on the downstream side of said venturi section.

8. The combustion defined by claim 7, wherein said first means includes flow directing means for causing the hot combustion-supporting gas to flow in swirling fashion.

9. The combination defined by claim 7, wherein said first means is constructed and arranged to supply the hot combustion-supporting gas generally concentrically about said second means.

10. The combination defined by claim 7 and further comprising a mixing valve having first and second inlets and an outlet;

means connecting one of the inlets of the mixing valve to receive gases from said gas outlet of the hearth;

means connecting the other of the inlets of the mixing valve to receive a hot combustion-supporting gas; and a duct leading from the outlet of the mixing valve to said elongated circuit in a location downstream of said venturi section, said third means being connected to supply ore and flux into said duct.

11. The combination defined by claim 7 and further comprising means for analyzing the gases in said turbulent flow after the ore and flux have been supplied thereto; and control means for controlling the supply rate of the ore and flux in accordance with analyses provided by said means for analyzing the gases in said turbulent flow.

12. The combination defined by claim 7, wherein said delivery end of said elongated conduit is arranged to discharge along a line which is generally tangential with respect to the pool of molten metal being recovered in the hearth.

* * * * *